United States Patent [19]

Schmidt et al.

[11] 4,094,476

[45] June 13, 1978

[54] THREAD SPOOL

[75] Inventors: Max Christof Schmidt, Bonnigheim; Richard Huber, Beilstein-Billenbach, both of Germany

[73] Assignee: Amann & Söhne, Bonnigheim, Germany

[21] Appl. No.: 837,844

[22] Filed: Sep. 29, 1977

[30] Foreign Application Priority Data

Oct. 1, 1976 Germany ..... 2644882

[51] Int. Cl.[2] ..... B65H 75/28

[52] U.S. Cl. ..... 242/125.2

[58] Field of Search ..... 242/125.2, 125.1, 125, 242/125.3, 118.4, 118.7, 18 PW, 18 EW

[56] References Cited

U.S. PATENT DOCUMENTS

| | | | |
|---|---|---|---|
| 1,906,495 | 5/1933 | Stine | 242/125.2 |
| 2,298,357 | 10/1942 | Elvin et al. | 242/125.1 |

*Primary Examiner*—George F. Mautz

*Attorney, Agent, or Firm*—Ralf H. Siegemund

[57] ABSTRACT

A regular thread spool has at least one of its end flange disks provided with a sectionalized groove, the sections being axially offset to provide thread retention baffles.

4 Claims, 4 Drawing Figures

THREAD SPOOL

BACKGROUND OF THE INVENTION

The present invention relates to a thread spool.

Generally speaking, such a spool has a tubular, sleeve-like body and two disk shaped end flanges. The German Pat. No. 1,535,149 discloses a thread spool in which one disk or flange has a peripheral, notch like groove. Moreover, several pin like protrusions are provided in the groove, extending at the most up to the upper rim of the groove. This groove serves for insertion of the thread end and for retaining it. However, it was found that this construction is relatively complicated to make, particularly if the spool is to be made from plural parts. Other known thread retention constructions include for example various slots for clamping the thread.

DESCRIPTION OF THE INVENTION

It is an object of the present invention to provide a new and improved thread spool construction, which permits single piece manufacturing, and in which the thread end portion can be securely retained without impeding unthreading when so desired.

In accordance with the preferred embodiment of the present invention it is suggested to improve a thread spool in that a disk shaped end flange thereof is provided with a peripheral groove configured to have two or more axially offset portions which are either joined by a gradual transition if the offset is relatively large, but an abrupt transition can be used for a smaller offset.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings FIG. 1 shows a thread spool having a sleeve member 1 and two disk shaped flanges 2, only one being shown in FIG. 1, the other one being for example configured in a conventional manner. The flange 2 illustrated has a thread receiving, notch like groove 3 which is divided into two sections 3*a* and 3*b* which communicate but are offset. The groove 3, therefore, is a continuing, endless one which loops around the periphery of disk 2.

The parallel offset of the groove portions is larger than the width *b* of the bottom of the groove. Strictly speaking, only the bottoms of the groove are offset in that manner. It can be seen that each groove section is of asymmetric, notch like configuration as to its cross-section; one wall being steeper than the other. The offset results from the fact that steepness is reversed (axially).

Figure 3:
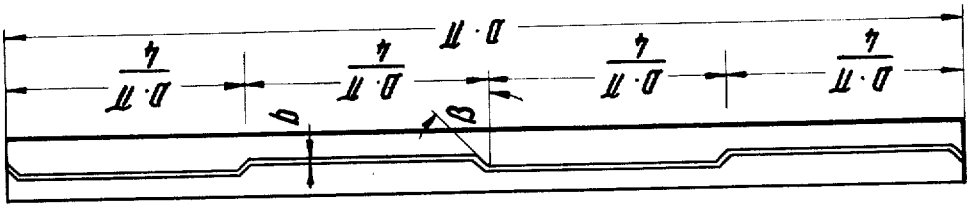
FIG. 3 is a development similar to FIG. 2 but for a thread groove have four offset sections.
Figure 2:
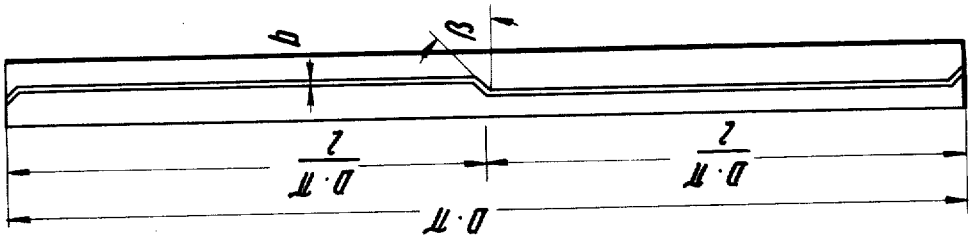
FIG. 2 is a schematic view of a geometric development of the thread groove of FIG. 1.
Figure 1:
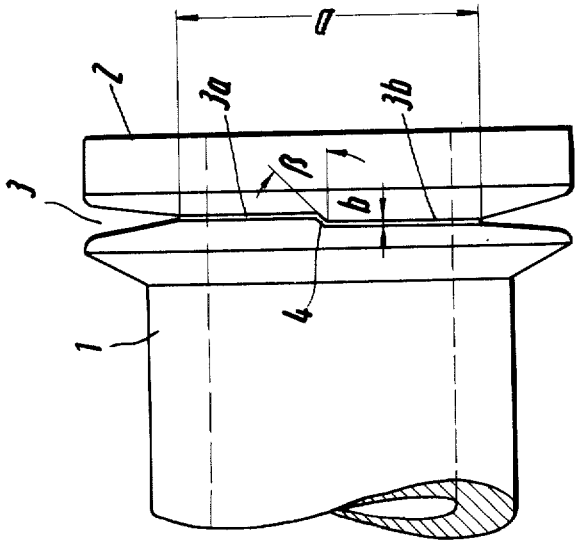
FIG. 1 is a side view of a portion of a thread spool having a thread groove configured as two mutually offset portions.

The two sections 3*a* and 3*b* have two transition portions 4 which have an angle $\beta$ relative to the axis of the spool and act as baffles for clamping a thread end which has been inserted and pulled into the groove. FIG. 2 is shown primarily for purposes of comparison. The development shows that the spool of FIG. 1 has two offset, baffle portions spaced at circumferential distances equal to about $D \times \pi/2$ wherein D is the diameter of the groove bottom. In the case of a four section and four baffle groove, these offset groove portions each have a circumferential length of $D \times \pi/4$ as shown in FIG. 3. All other features remain the same.

Figure 4:
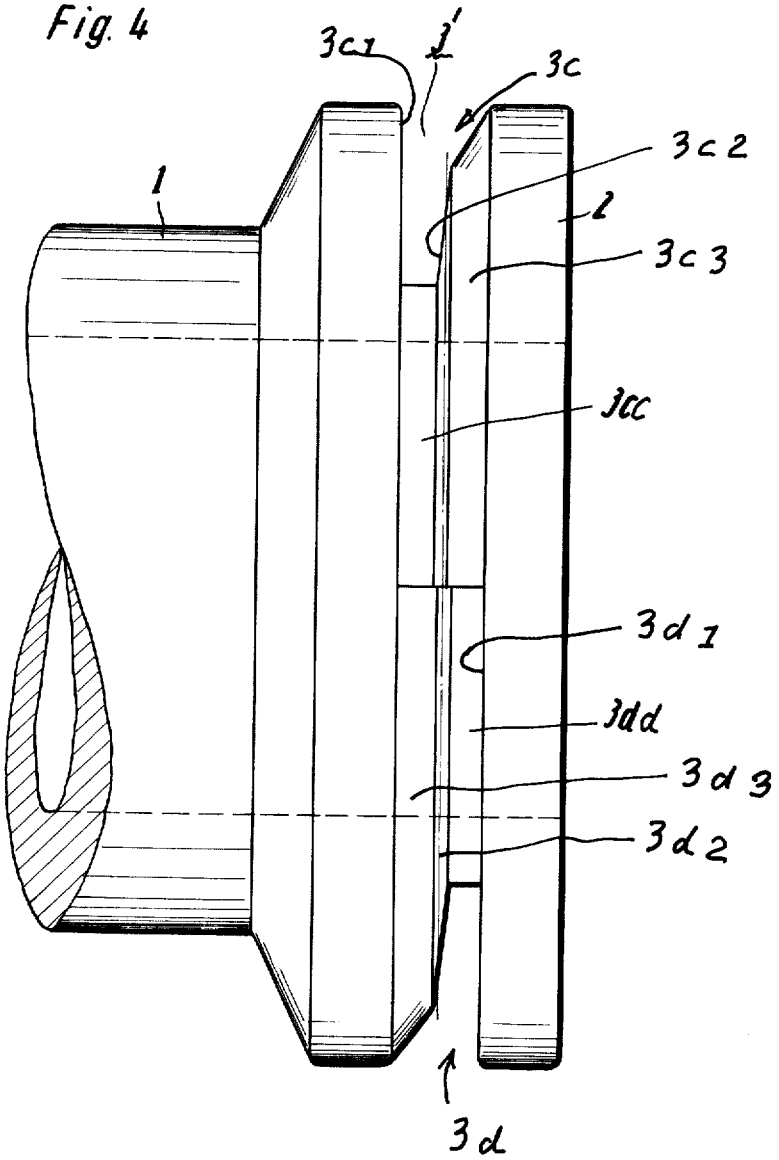
FIG. 4 is a view similar to FIG. 1 but of a spool with threadgroove whose offset is smaller than the width of the groove at the bottom thereof.

The particular spool shown in FIG. 4 has also a sleeve body 1 and a flange member 2 provided with a groove 3' which is also divided into two sections 3*c*, 3*d* however without gradual transition zone. The offset results also have from a mirror symmetry in the cross-section. Take section 3*a*, it is defined by a planar, flat side wall 3*cl*, a bottom 3*cc*, a rather shallow tapered side wall 3*c*2 and a portion with a more pronounced taper, 3*c*3. The groove 3*d* is configured inversely with a planar wall 3*dl*, and two tapered, opposite walls 3*d*2, 3*d*3. The mirror image asymmetry of the crosssectional profile results in an offset of the bottoms 3*cc* and 3*dd*. The offset is less than the width of the grooves in the sense that the axial spacing of the junction of walls 3*c*2 and 3*cc* is axially spaced from the junction of walls 3*d*2 and 3*dd* by a distance less than the width of either bottom 3*dd* or 3*cc*. The rather abrupt transition between the two groove portions 3*c* and 3*d* (two of them) permit clamping of an inserted piece of thread.

It was found that either of the spools can be made economically in a rather simple fashion and as a single piece elements. The thread or thread end piece is readily retained in either of the grooves.

The invention is not limited to the embodiments described above but all changes and modifications thereof not constituting departures from the spirit and scope of the invention are intended to be included.

We claim:

1. Thread spool having a sleeve and two flanges, at least one of the flanges having a notch like peripheral groove for inserting the end piece of a thread, the improvement comprising, the groove having at least two sections which are offset in direction of a spool axis, the sections establishing a single closed groove.

2. Thread spool as in claim 1 wherein the groove sections have a cross-sectional profile which are mirror images from each other.

3. Thread spool as in claim 1 and including gradual, oblique transition portions of the sections for an offset larger than the width of the bottom of the groove.

4. Thread spool as in claim 1, and including abrupt transitions between the sections for an offset smaller than the width of the bottom of the groove.

* * * * *